US011613960B2

(12) United States Patent
Doane

(10) Patent No.: US 11,613,960 B2
(45) Date of Patent: Mar. 28, 2023

(54) MECHANICAL STEPPER

(71) Applicant: James Christopher Doane, Friendswood, TX (US)

(72) Inventor: James Christopher Doane, Friendswood, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/895,501

(22) Filed: Aug. 25, 2022

(65) Prior Publication Data

US 2022/0403712 A1 Dec. 22, 2022

Related U.S. Application Data

(62) Division of application No. 16/811,156, filed on Mar. 6, 2020, now Pat. No. 11,466,537.

(51) Int. Cl.
*E21B 34/06* (2006.01)
*E21B 34/14* (2006.01)

(52) U.S. Cl.
CPC ..... *E21B 34/06* (2013.01); *E21B 34/14* (2013.01); *E21B 2200/06* (2020.05)

(58) Field of Classification Search
CPC ..... E21B 34/06; E21B 2200/06; E21B 33/00; E21B 23/00; E21B 23/02; E21B 23/06; E21B 34/14; F16H 27/02
See application file for complete search history.

(56) References Cited

U.S. PATENT DOCUMENTS 4,607,865 A * 8/1986 Hughes ..... E21B 33/038 285/392
4,989,902 A * 2/1991 Putch ..... E21B 17/04 285/392
5,472,055 A 12/1995 Simson et al.
8,246,065 B1 * 8/2012 Kodama ..... B62J 1/08 280/278

(Continued)

FOREIGN PATENT DOCUMENTS

WO 9627732 A2 9/1996
WO 2016172323 A1 10/2016
WO WO-2016172323 A1 * 10/2016 ..... E21B 33/12

OTHER PUBLICATIONS

International Search Report and Written Opinion Issued in International Application No. PCT/US2021/019661 dated Jun. 15, 2021; 6 Pages.

*Primary Examiner* — George S Gray
(74) *Attorney, Agent, or Firm* — Cantor Colburn LLP

(57) ABSTRACT

A mechanical stepper and method of incrementally actuating a device. An insert is placed within a housing. The housing has a cavity and a stepper sleeve located within the cavity. The stepper sleeve includes a first stop member having an equilibrium position defined by a first equilibrium diameter and a second stop member having an equilibrium position defined by a second equilibrium diameter less than the first equilibrium diameter. The insert including a first protrusion. The insert moves through the housing, and motion of the insert through the housing is incrementally restricted by changing a diameter of the first stop member and a diameter of the second stop member via the first protrusion.

1 Claim, 18 Drawing Sheets

(56) References Cited

U.S. PATENT DOCUMENTS

| | | | | |
|---|---|---|---|---|
| 2010/0006302 | A1* | 1/2010 | Johnson | E21B 23/00<br>166/373 |
| 2014/0166314 | A1 | 6/2014 | Black | |
| 2021/0277742 | A1 | 9/2021 | Doane | |

* cited by examiner

MECHANICAL STEPPER

CROSS-REFERENCE TO RELATED APPLICATIONS

This application is a Divisional application of U.S. patent application Ser. No. 16/811,156 filed Mar. 6, 2020, the disclosure of which is incorporated herein by reference in its entirety.

BACKGROUND

In the resource recovery industry, production includes the flow of fluid from a formation into a tubular in order to transport to a surface location. There is however a need to be able to control the amount of fluid flowing through the tubular and therefore to regulate flow of fluid into the tubular.

SUMMARY

Disclosed herein is a method of incrementally actuating a device. An insert is placed within a housing, the housing having a cavity and a stepper sleeve located within the cavity, the stepper sleeve including a first stop member having an equilibrium position defined by a first equilibrium diameter and a second stop member having an equilibrium position defined by a second equilibrium diameter less than the first equilibrium diameter. The insert including a first protrusion. The insert is moved through the housing. Motion of the insert through the housing is incrementally restricted by changing a diameter of the first stop member and a diameter of the second stop member via the first protrusion.

Also disclosed here is a mechanical stepper. The mechanical stepper includes a housing having a cavity on an inner diameter surface, a stepper sleeve within the cavity, the stepper sleeve including a first stop member having an equilibrium position defined by a first equilibrium diameter, and a second stop member having an equilibrium position defined by a second equilibrium diameter less than the first equilibrium diameter, and an insert within the housing and movable with respect to the housing, the insert including a protrusion. The insert moves incrementally through the housing via interaction between the protrusion on the insert and the first stop member and the second stop member.

Also disclosed herein is a mechanical stepper. The mechanical stepper includes a housing having a protrusion on an inner diameter surface, an insert within the housing and movable with respect to the housing, the insert including a cavity on its outer surface, and a stepper sleeve within the cavity, the stepper sleeve including a first stop member having an equilibrium position defined by a first equilibrium diameter and a second stop member having an equilibrium position defined by a second equilibrium diameter greater than the first equilibrium diameter. The insert moves incrementally through the housing via interaction between the protrusion on the housing and the first stop member and the second stop member.

BRIEF DESCRIPTION OF THE DRAWINGS

The following descriptions should not be considered limiting in any way.

With reference to the accompanying drawings, like elements are numbered alike.

DETAILED DESCRIPTION

A detailed description of one or more embodiments of the disclosed apparatus and method are presented herein by way of exemplification and not limited with reference to the Figures.

Figure 1:
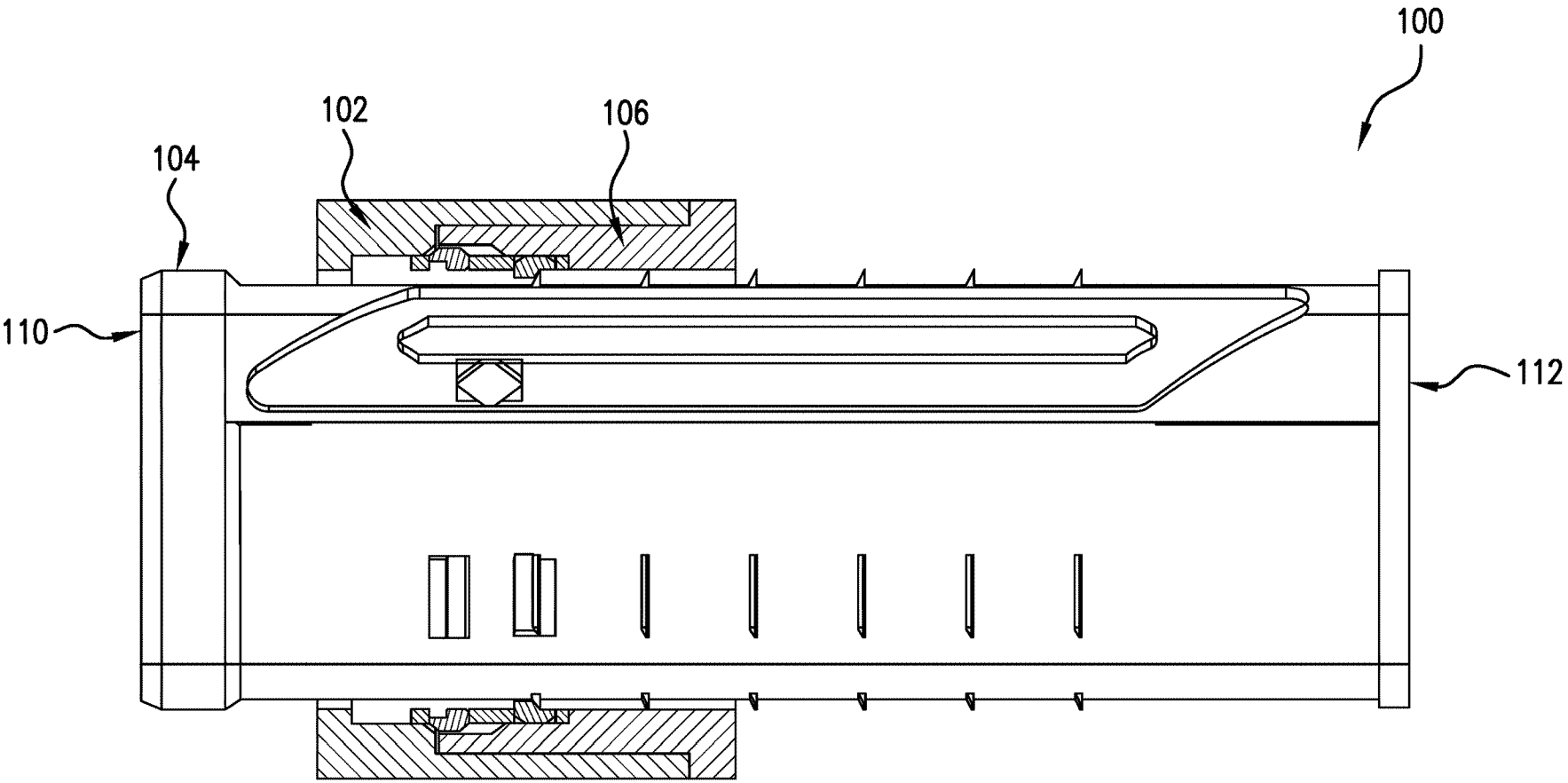
FIG. 1 shows a mechanical stepper in an embodiment.

Referring to FIG. 1, a mechanical stepper 100 is shown in an embodiment. The mechanical stepper 100 includes a housing 102, an insert 104 movable through the housing 102 and a stepper sleeve 106 that resides within the housing 102. The stepper sleeve 106 extends circumferentially around a section of the insert 104 and is slidable along an outer surface of the insert 104. The mechanical stepper 100 extends longitudinally between a first end 110 and second end 112 opposite the first end 110, as is indicated in FIG. 1.

The terms "left" and "right" are used herein to describe relative positions and/or orientations of various elements as well as relative directions of motion of these elements, as viewed in the Figures. It is to be understood use of the terms "left" and "right" is meant only for ease of explanation and is not meant as a limitation on the invention. A first element being to the left of a second element indicates that the first element is closer to the first end 110 than the second element. Similarly, a first element being to the right of a second element indicates that the first element is closer to the second end 112 than the second element. Additionally, an element moving left is moving from the second end to the first end and an element moving right is moving from the first end to the second end.

Figure 2:
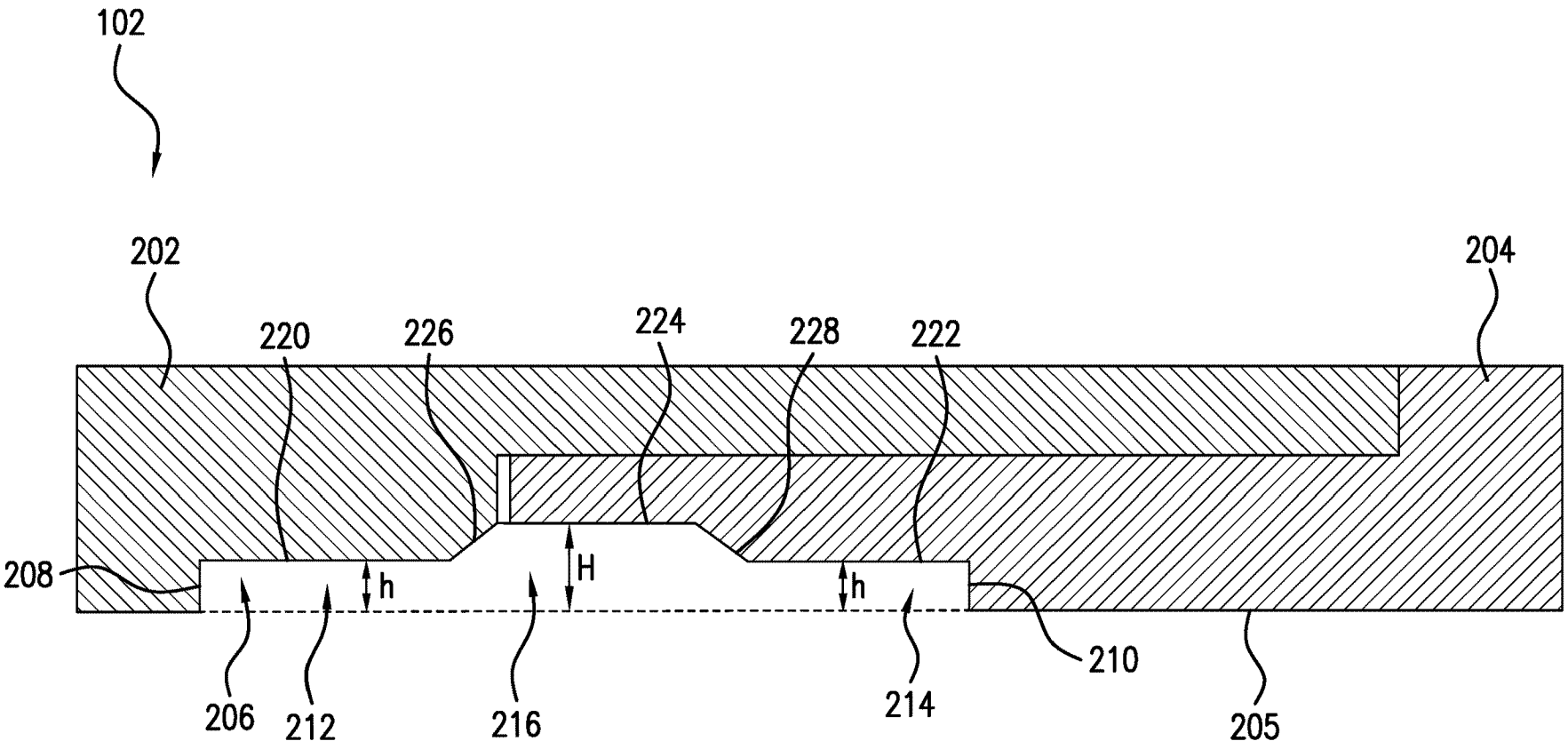
FIG. 2 shows a side view of a cross section of a housing of the mechanical stepper.

FIG. 2 shows a side view of a cross section of the housing 102 of the mechanical stepper 100. The housing 102 is a member having a longitudinal bore therethrough. The housing 102 includes a first housing section 202 and a second housing section 204 which, when combined, form a cavity 206 on an inner diameter surface 205 of the housing 102. In alternate embodiments, the housing 102 can be a single component having a cavity 206. The cavity 206 extends from a first end wall 208 to a second end wall 210. The cavity 206 includes first restricted region 212, a second restricted region 214 and an expanded region 216 that lies axially between the first restricted region 212 and second restricted region 214. The first restricted region 212 lies to the left of the expanded region 216 and has a first restricted outer surface 220 that is radially separated from the inner diameter surface 205 of the housing 102 by a radial depth 'h'. The second restricted region 214 lies to the right of the expanded region 216 and has a second restricted outer surface 222 that is radially separated from the inner diameter surface 205 of the housing 102 by radial depth 'h'. The expanded region 216 has an expanded outer surface 224 that is radially separated from the inner diameter surface 205 of the housing 102 by a radial depth 'H', where H>h. Although the radial depth of the first restricted region 212 and the second restricted region 214 are both less than the radial depth of the expanded region 216, in various embodiments, the radial depth of the first restricted region 212 can be different that the radial depth of the second restricted region 214. A first sloped surface 226 connects the expanded outer surface 224 to the first restricted outer surface 220. Similarly, a second sloped surface 228 connects the expanded outer surface 224 to the second restricted outer surface 222. Although shown in cross-section, it is understood that the cavity 206 extends circumferentially around the inside of the housing 102.

Figure 3:
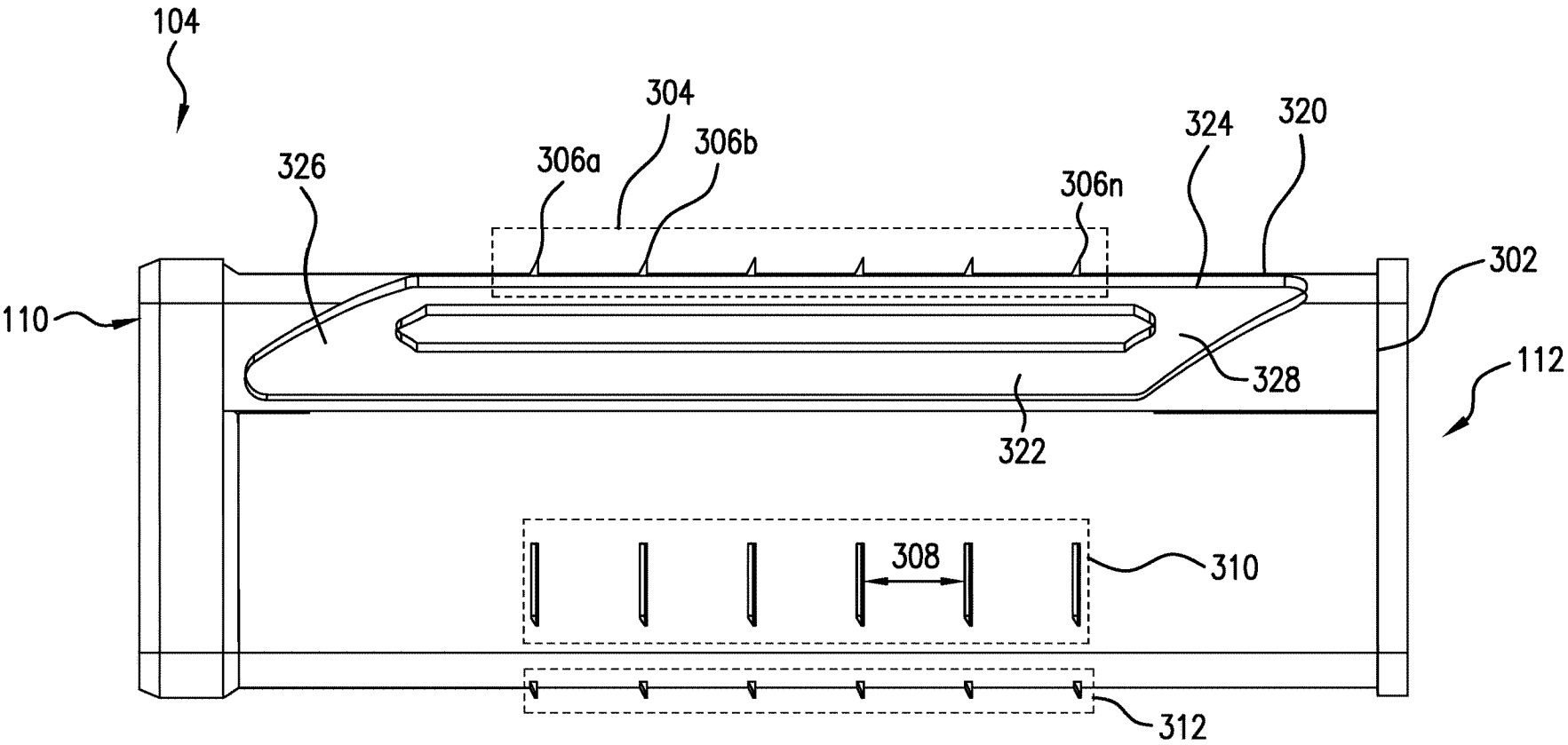
FIG. 3 shows an insert of the mechanical stepper.

FIG. 3 shows an insert 104 of the mechanical stepper 100. In an embodiment, the insert 104 includes a body 302 extending from first end 110 to second end 112 and defining a bore therethrough. The insert 104 includes one or more groups of protrusions. In the illustrative embodiment of FIG. 3, the insert shows a first protrusion group 304, second protrusion group 310 and third protrusion group 312. Each protrusion group is at a selected azimuthal location on the outer surface of the insert 104. Each protrusion group also includes a plurality of protrusions 306*a*, 306*b*, . . . , 306*n* axially separated from each other in the longitudinal direction by a selected protrusion spacing 308. Each protrusion 306*a*, 306*b*, . . . , 306*n* has a selected circumferential length to cover only a portion of a circumference of the insert 104. Each protrusion 306*a*, 306*b*, . . . , 306*n* has a non-perpendicular angled surface facing the first end 110 and a surface that is at an angle to the outer surface of the insert 104 facing the second end 112. The angle can be perpendicular plus or minus 15 degrees, in various embodiments.

The insert 104 further includes a grooved track 320 formed into its outer surface. The grooved track 320 includes a first axial slot 322 and a second axial slot 324 circumferentially displaced from the first axial slot. A first angled cross-slot 326 connects the first axial slot 322 to the second axial slot 324 at one axial end of the grooved track 320. A second angled cross-slot 328 connects the first axial slot 322 to the second axial slot 324 at an opposite axial end of the grooved track 320.

Figure 4:
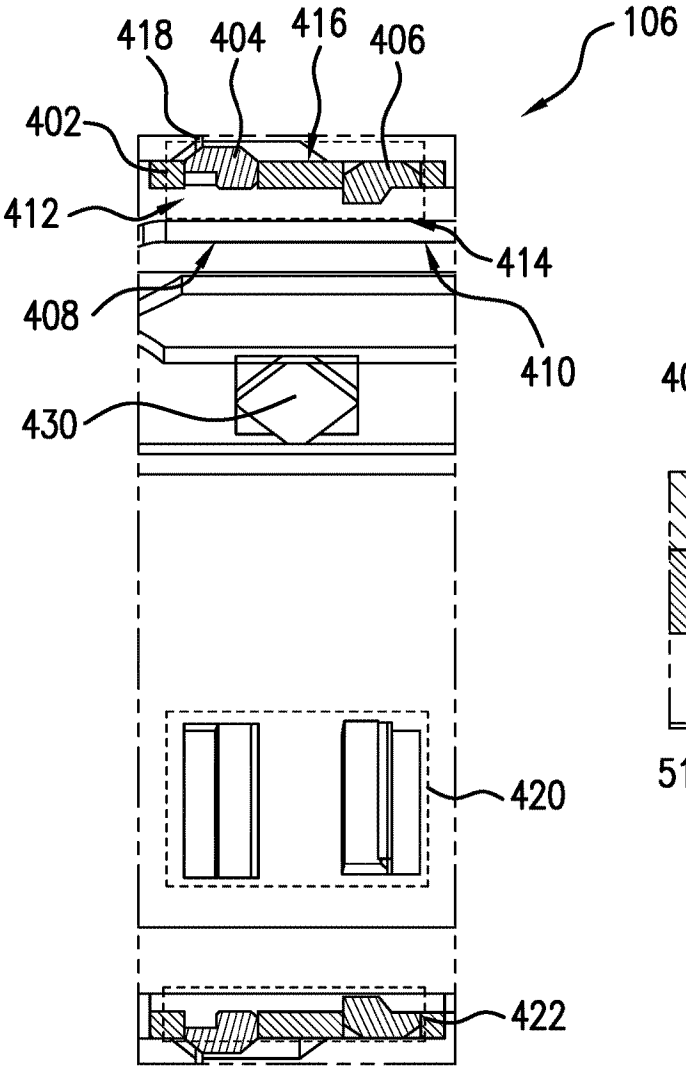
FIG. 4 shows a cross-sectional view of a stepper sleeve of the mechanical stepper.

FIG. 4 shows a cross-sectional view 400 of the stepper sleeve 106 of the mechanical stepper 100. The cross-sectional view 400 shows an interior surface of the stepper sleeve 106. The stepper sleeve 106 includes a carrier 402, a first stop member 404 and a second stop member 406. In various embodiments, the first stop member 404 is a first C-ring and the second stop member 406 is a second C-ring. The first C-ring and second C-ring extend partially around the circumference of the carrier 402. The first stop member 404 has a first equilibrium diameter when in a natural state in which no force is applied. The second stop member 406 has a second equilibrium diameter when in a natural state in which no force is applied. In other words, an equilibrium position of the first stop member 404 is defined by the first stop member 404 having the first equilibrium diameter and an equilibrium position of the second stop member 406 is defined by the second stop member 406 having the second equilibrium diameter. The first equilibrium diameter is greater than the second equilibrium diameter. The first stop member 404 and the second stop member 406 are each flexible in order to be able expand or contract radially.

The first stop member 404 and second stop member 406 each can be independently or separately moved between an expanded state and a collapsed state. For the first stop member 404, the expanded state is when the first stop member 404 is at its equilibrium position (i.e., at the first equilibrium diameter). In the collapsed state, the first stop member 404 has a diameter that is less that the first equilibrium diameter. In a non-limiting embodiment, the diameter of the first stop member 404 in the collapsed state is the second equilibrium diameter.

For the second stop member 406, the collapsed state is when the second stop member 406 is at its equilibrium position (i.e., at the second equilibrium diameter). In the expanded state, the second stop member 406 has a diameter that is greater than the second equilibrium diameter. In a non-limiting embodiment, the diameter of the second stop member 406 in the expanded state is the first equilibrium diameter.

In various embodiments, in an expanded state, the stop member is in a radially outward position away from the carrier 402 and in the collapsed state, the outer surface of the stop member is flush with or below an outer surface of the carrier 402.

The first stop member 404 resides at a first axial location 408 of the carrier 402. The carrier 402 can include a first circumferential track at the first axial location 408 to guide or contain the first stop member 404. Similarly, the second stop member 406 resides at a second axial location 410 of the carrier 402, and the carrier 402 can include a second circumferential track at the second axial location 410 to guide or contain the second stop member 406. The first axial location 408 is closer to the first end 110 and the second axial location 410 is closer to the second end 112.

The carrier 402 further includes circumferentially spaced aperture groups. The illustrative carrier 402 of FIG. 3 shows a first aperture group 418, second aperture group 420 and third aperture group 422. Each aperture group including a first aperture 412 and a second aperture 414 axially separated from each other. These apertures are discussed further with respect to the first aperture group 418, for ease of explanation.

The first aperture group 418 includes a first aperture 412 at the first axial location 408 and a second aperture 414 at the second axial location 410. The first aperture 412 can hold at least a portion of the first stop member 404 and the second aperture 414 can hold at least a portion of the second stop member 406. The first aperture 412 and second aperture 414 are separated by an intra-track region 416 having a selected axial length.

The carrier 402 further includes a lug 430 on its inner diameter surface that extends radially inward from the inner diameter surface. The lug 430 interacts with the grooved track 320 of the insert 104 in order to rotate the stepper sleeve 106 with respect to the insert 104, as discussed below in further detail with respect to FIGS. 13-18.

Figure 5:
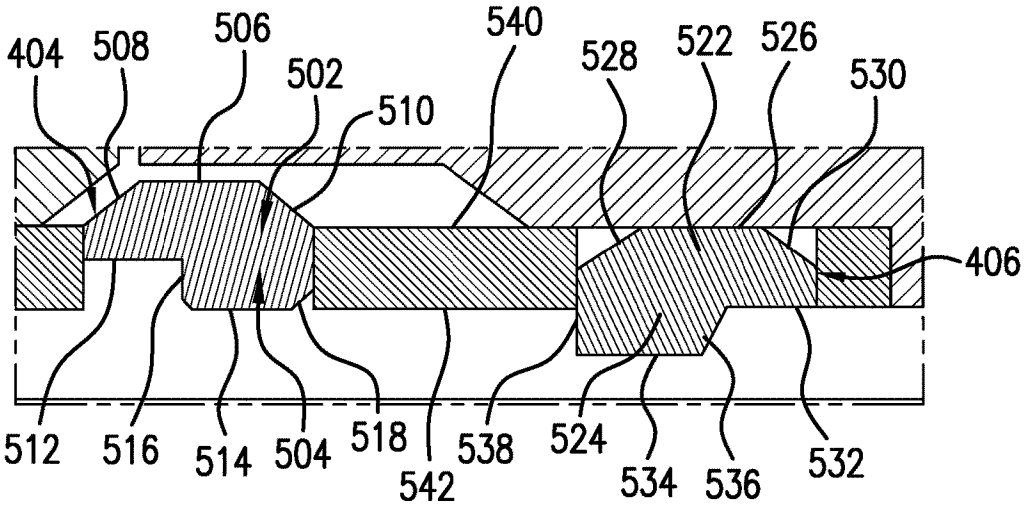
FIG. 5 shows a close up of the carrier, depicting details of a first stop member and a second stop member.

FIG. 5 shows a close up of the carrier 402, depicting details of the first stop member 404 and the second stop member 406 in an embodiment. As shown in FIG. 5, the first stop member 404 is located to the left of the second stop member 406.

The first stop member 404 includes a stop portion 502 and an inner flange 504. The stop portion 502 includes an outer stop surface 506. A left sloped surface 508 is at a left side of the outer stop surface 506 and a right sloped surface 510 is at a right side of the outer stop surface 506. The left sloped surface 508 is at an angle that matches the angle of the first sloped surface 226 of the housing 102. The inner flange 504 extends radially inward from the stop portion 502. The stop portion 502 defines an inner stop surface 512 and the inner flange defines an inner flange surface 514. A step surface 516 extends from the inner stop surface 512 to the inner flange surface 514 in a perpendicular manner. The step surface 516 can form any suitable angle include, but not limited to, a perpendicular angle. The angle of the step surface 516 can match the angle of the protrusions 306*a*, 306*b*, . . . , 306*n*. However, this is not a necessary limitation. The step surface 516 is exposed to the first end 110. The right side of the inner flange 504 includes an angled surface 518.

The angled surface 518 can match the respective surface of the protrusions 306*a*, 306*b*, . . . , 306*n*. However, this is not a necessary limitation. In a second radial state, the outer stop surface 506 is flush with an outer surface 540 of the carrier 402 and the inner flange 504 extends through the first aperture 412 to a position that lies radially inside the carrier.

The second stop member 406 includes a stop portion 522 and an inner flange 524. The stop portion 522 includes an outer stop surface 526. A left sloped surface 528 is at a left side of the outer stop surface 526 and a right sloped surface 530 is at a right side of the outer stop surface 526. The right sloped surface 530 is at an angle that matches the angle of the second sloped surface 228 of the housing 102. The inner flange 524 extends radially inward from the stop portion 522. The stop portion 522 defines an inner stop surface 532 and the inner flange defines an inner flange surface 534. An angled step surface 536 extends from the inner stop surface 532 to the inner flange surface 534. The angled step surface 536 is exposed to the right of the second stop member 406. The left side of the inner flange 524 includes a perpendicular surface 538. The angles of the perpendicular surface 538 and of the angled step surface 536 can match the respective surfaces of the protrusions 306*a*, 306*b*, . . . , 306*n* that interact with these surfaces. However, this is not a necessary limitation. In the expanded state, the inner stop surface 534 is flush with an inner surface 542 of the carrier 402 and the inner flange 524 extends through the second aperture 414 to a position that lies radially inside the carrier 402.

FIGS. 6-12 Illustrate an operation of the mechanical stepper 100 to perform a stepped motion of the insert 104 with respect to the housing 102. The insert 104 moves within the housing 102 along a shared longitudinal axis. In various embodiments, the stepped motion of the insert 104 can be used to incrementally actuate a device.

Figure 6:
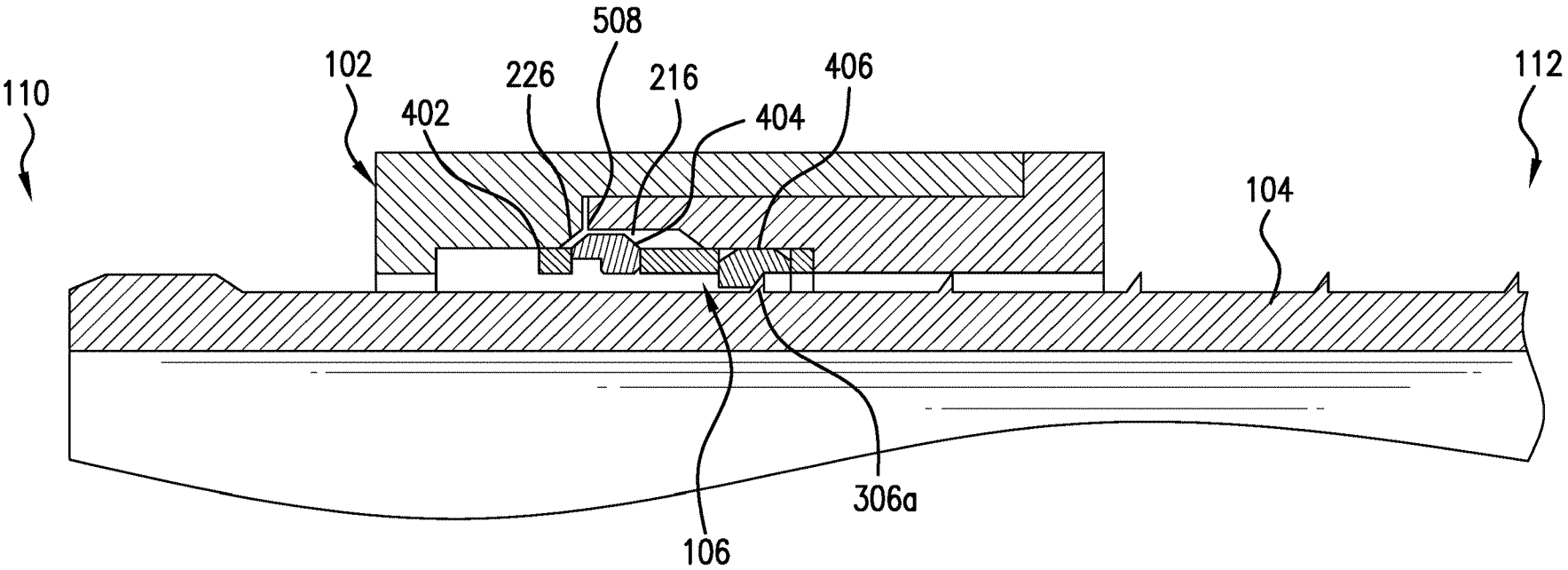
FIG. 6 illustrates a first step of the insert within the housing to produce a stepping motion.

FIG. 6 illustrates a first step of the insert 104 within the housing 102 to produce a stepping motion. The stepper sleeve 106 is in a first position or a right-most position with the carrier 402 abutted against the second end wall 210 of the cavity 206. In this position of the carrier 402, the first stop member 404 lies within the expanded region 216. Since the first stop member 404 is in an expanded state (i.e., in its equilibrium position), it extends to the expanded outer surface 224 of the cavity. The second stop member 406 is confined to the second restricted region 214 and is in a collapsed state (i.e., in its equilibrium position). The insert 104 is located with its protrusions 306*a*, 306*b*, . . . , 306*n* located to the right of the housing 102 and moves in a first direction from right to left within the stepper sleeve 106, thereby bringing a first protrusion 306*a* (i.e., left-most protrusion) into forming a first contact with the inner flange 524 of the second stop member 406.

Figure 7:
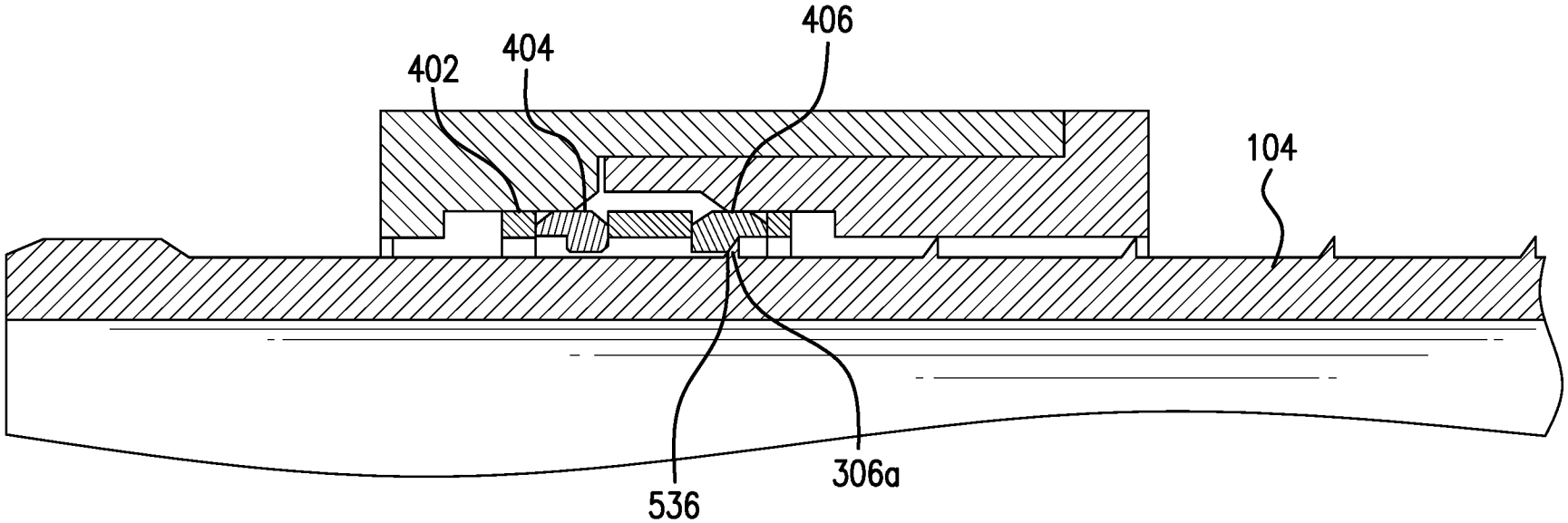
FIG. 7 illustrates a second step for producing the stepped motion.

FIG. 7 illustrates a second step for producing the stepped motion. The insert 104 continues to move to the left, thereby exerting a force on the carrier 402 to move to the left from the first position to a second position. The first protrusion 306*a* pushes against the angled step surface 536 to push the carrier 402 to the left. As the carrier 402 moves to the left, the first stop member 404 is forced into a collapsed state via interaction between the left sloped surface 508 of the first stop member 404 and the first sloped surface 226 of the housing 102.

Figure 8:
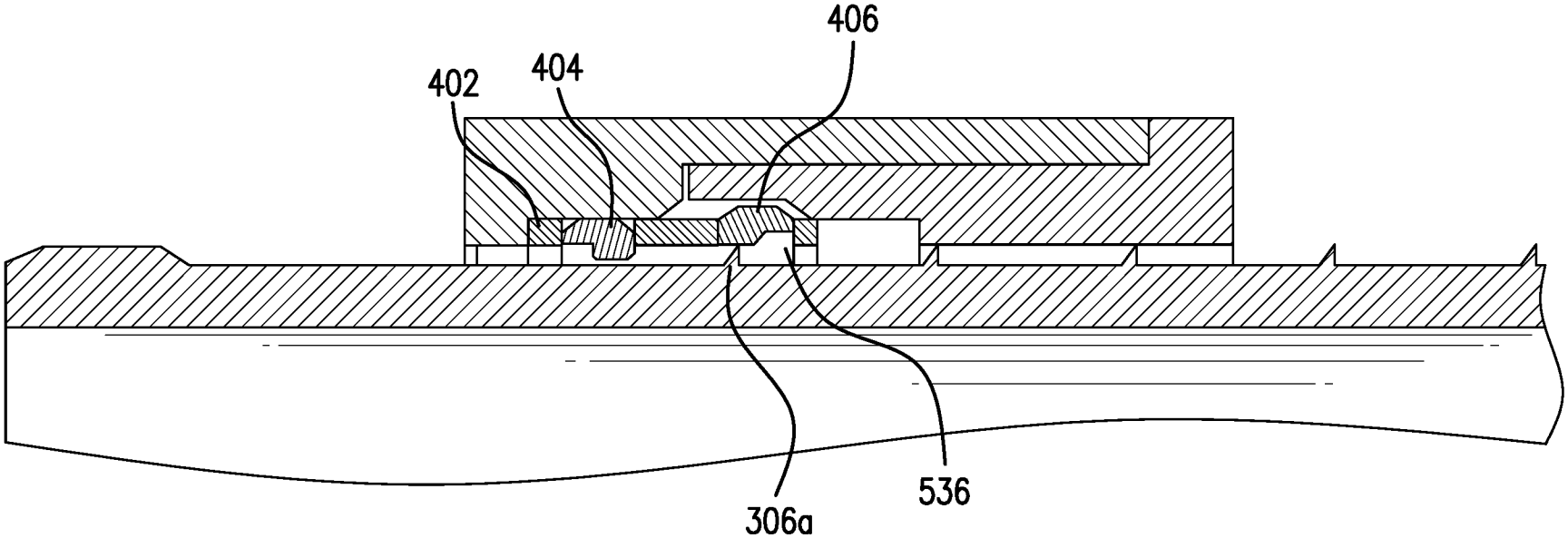
FIG. 8 illustrates a third step for producing the stepped motion.

FIG. 8 illustrates a third step for producing the stepped motion. Moving the insert 104 to the left now places the carrier 402 in the second position in which the carrier 402 abuts against first end wall 208 of the cavity 206. The first stop member 404 is confined to the first restricted region 212 and is therefore in a collapsed state. The second stop member 406 enters the expanded region 216. Although the equilibrium position for the second stop member 406 is the collapsed state, the first protrusion 306*a* pushes against the angled step surface 536 of the second stop member 406 to force it into an expanded state. With the second stop member 406, in the expanded state, the first protrusion 306*a* now has access to further motion in the first direction. The first protrusion 306*a* moves underneath the second stop member 406 and into the intra-track region 416 of the carrier 402. Once the first protrusion 306*a* is in the intra-track region 416 and is no longer underneath the second stop member 406, the second stop member 406 collapses back into the collapsed state.

Figure 9:
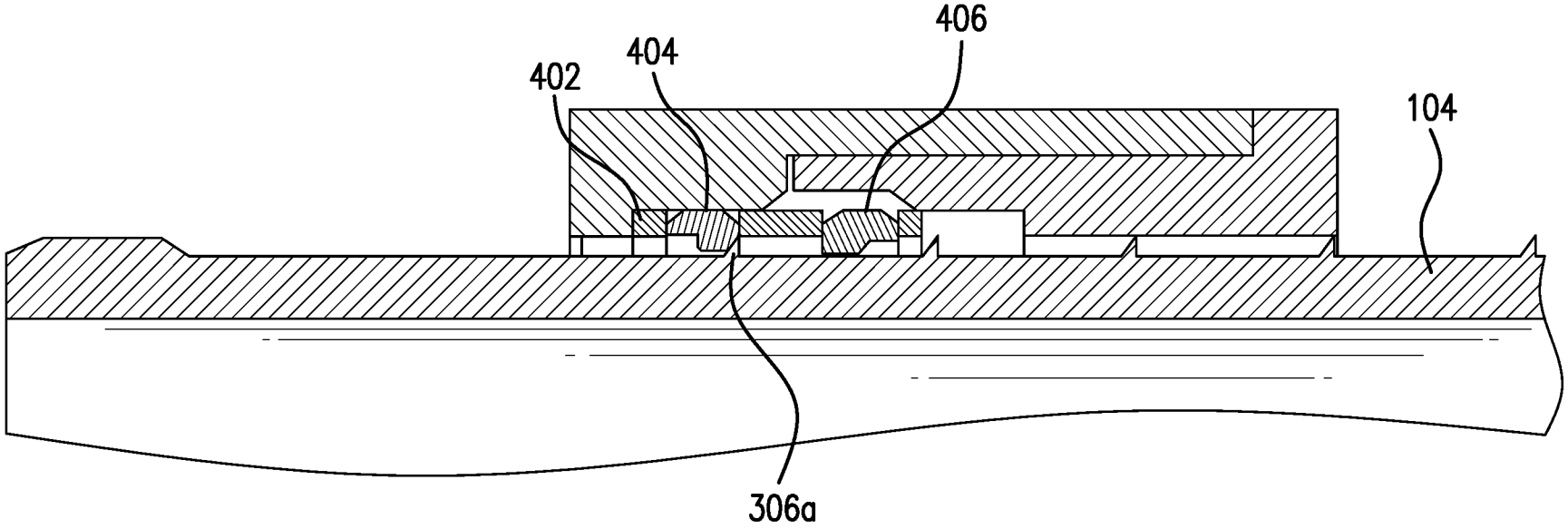
FIG. 9 illustrates a fourth step for producing the stepping motion.

FIG. 9 illustrates a fourth step for producing the stepping motion. With the carrier 402 in the second position and prevented from moving any further to the left, the insert 104 continues to move left to bring the first protrusion 306*a* against the first stop member 404, thereby preventing any further left-ward motion of the insert 104.

Figure 10:
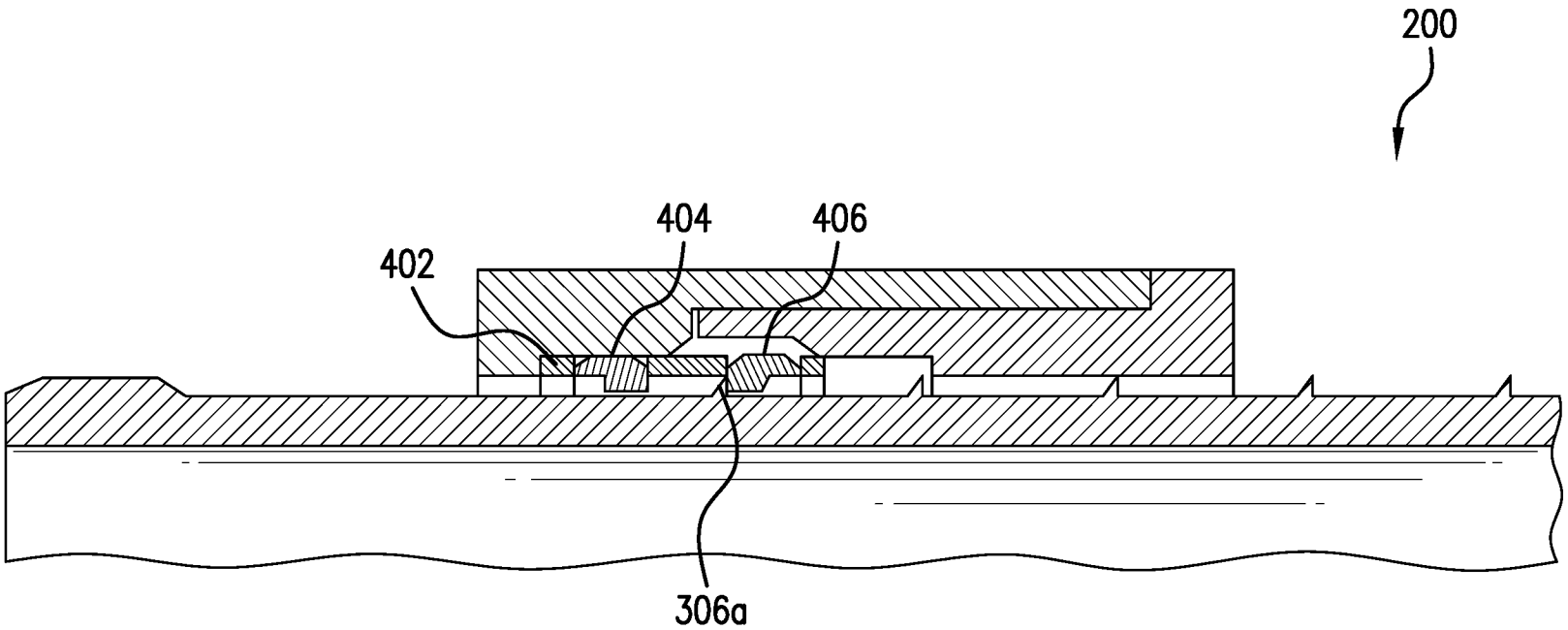
FIG. 10 illustrates a fifth step for producing the stepping motion.

FIG. 10 illustrates a fifth step for producing the stepping motion. With the carrier 402 in a second position, the insert 104 is now moved in a second direction (to the right), thereby bringing the first protrusion 306*a* into forming a second contact with the second stop member 406 at perpendicular surface 538, which matches the perpendicular surface of the first protrusion 306*a*.

Figure 11:
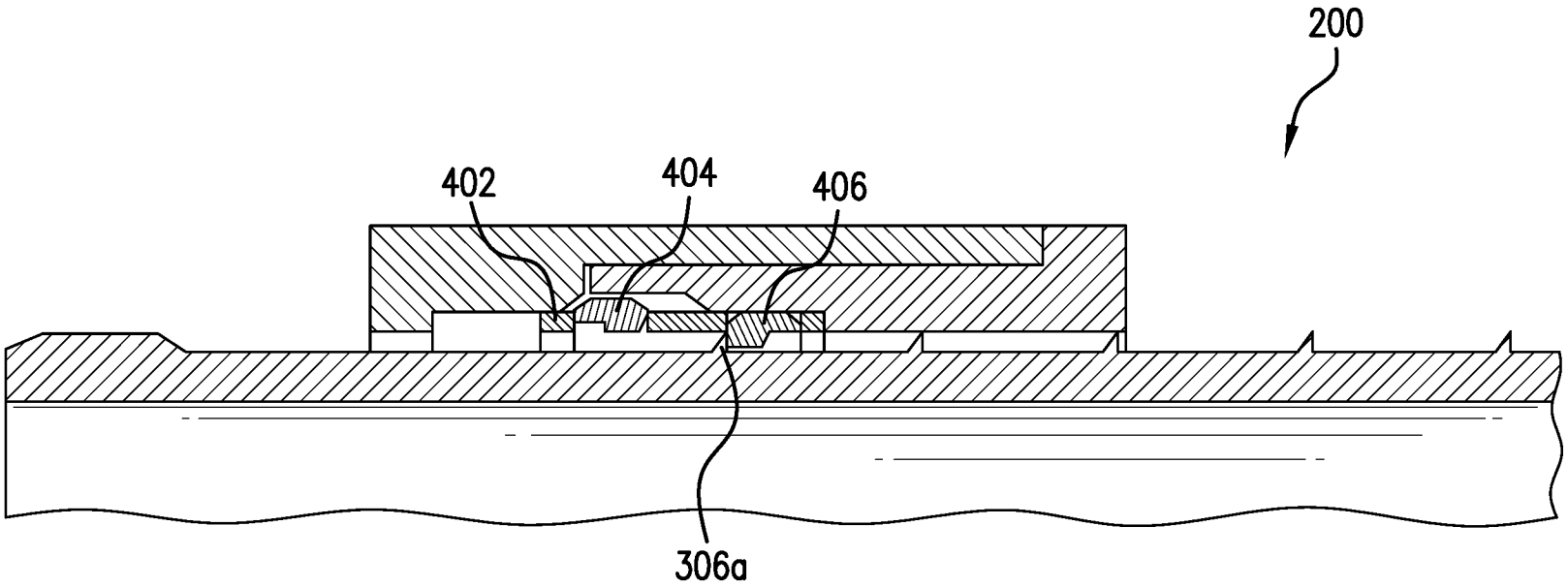
FIG. 11 shows a sixth action for producing the stepping motion.

FIG. 11 shows a sixth action for producing the stepping motion. The insert 104 continues moving in the second direction, causing the first protrusion 306*a* to push against perpendicular surface 538 of the inner flange 524 of the second stop member 406, thereby moving the carrier 402 back to the first position in which it abuts against second end wall 210 of the cavity 206, thereby preventing any further right-ward motion of the insert 104. The second stop member 406 therefore moves within the second restricted region 214 of the cavity 206. The first stop member 404 enters the expanded region 216 and expands radially outward against the expanded outer surface 224 of the expanded region 216, thereby relaxing back to the expanded state.

Figure 12:
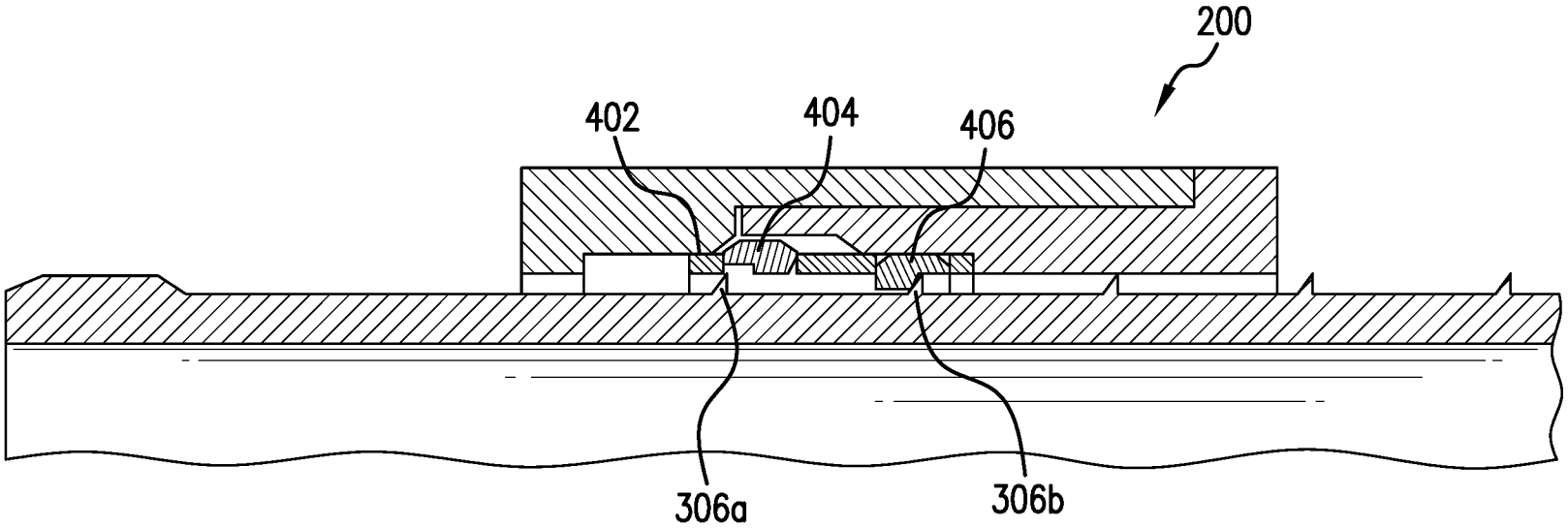
FIG. 12 shows a seventh action for producing the stepping motion.

FIG. 12 shows a seventh action for producing the stepping motion. The insert 104 is once again moved in the first direction. Since the first stop member 404 is in the expanded state, the first protrusion 306*a* moves to left unhindered. In fact, there is no substantial contact between the insert 104 and the carrier 402 until a second protrusion 306*b* comes into contact with the angled step surface 536 of the second stop member 406. At this point, the carrier 402 is in the same position as in FIG. 6. The only difference is that the first protrusion 306*a* has moved through the carrier 402 and a second protrusion 306*b* is in the same position in FIG. 12 as the first protrusion 306*a* was in FIG. 6. The second protrusion is therefore now in position to repeat the stepping motions outlined in FIGS. 6-12. These steps can therefore be repeated until the final or right-most protrusion 306*n* passes to the left of the carrier 402. The insert can be returned to its right-most position once the last protrusion 306*n* has passed the carrier, using the methods described below with respect to FIGS. 13-18.

FIGS. 13-18 illustrate methods for moving the insert 104 to the right with respect to the housing 102. The method uses the grooved track 320 of the insert to align or unaligned the protrusions 306*a*, 306*b*, . . . 306*n* with the first stop member 404 and second stop member 406 of the carrier 402

Figure 13:
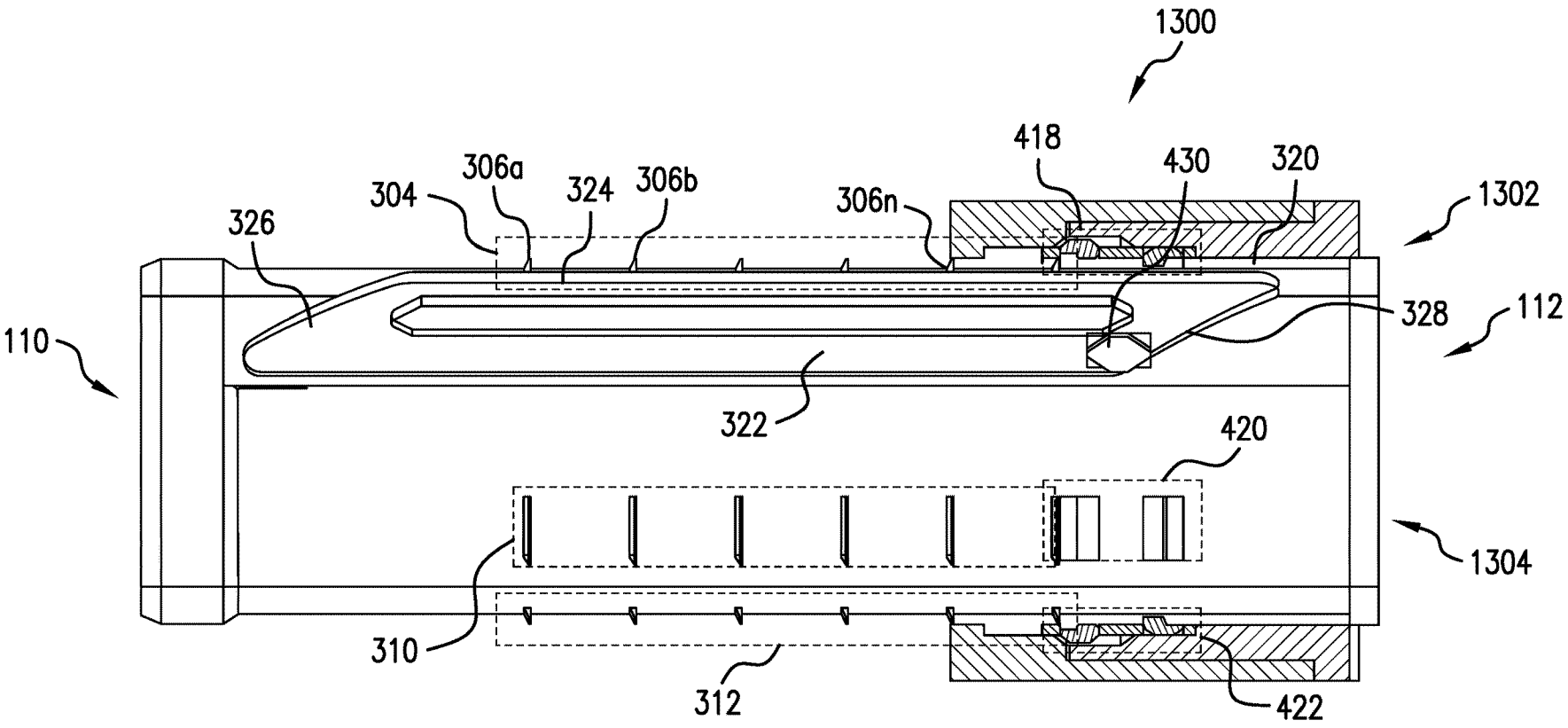
FIG. 13 shows the insert of the mechanical stepper with its protrusions to the left of the stepper sleeve.

FIG. 13 shows the insert 104 of the mechanical stepper 100 with its protrusions 306*a*, 306*b*, . . . , 306*n* to the left of the stepper sleeve 106. The first protrusion group 304 is shown at a same circumferential location 1302 as the first aperture group 418. Similarly, the second protrusion group 310 is circumferential aligned with second aperture group 420 and third protrusion group 312 is aligned with third aperture group 422. In this configuration, the insert 104 and stepper sleeve 106 are aligned to produce a stepping motion as shown previously in FIGS. 6-12.

Since the protrusions 306*a*, 306*b*, . . . , 306*n* have all moved to the left of the carrier 402, the lug 430 of the carrier 402 is at a right-most end of the first axial slot 322.

Figure 14:
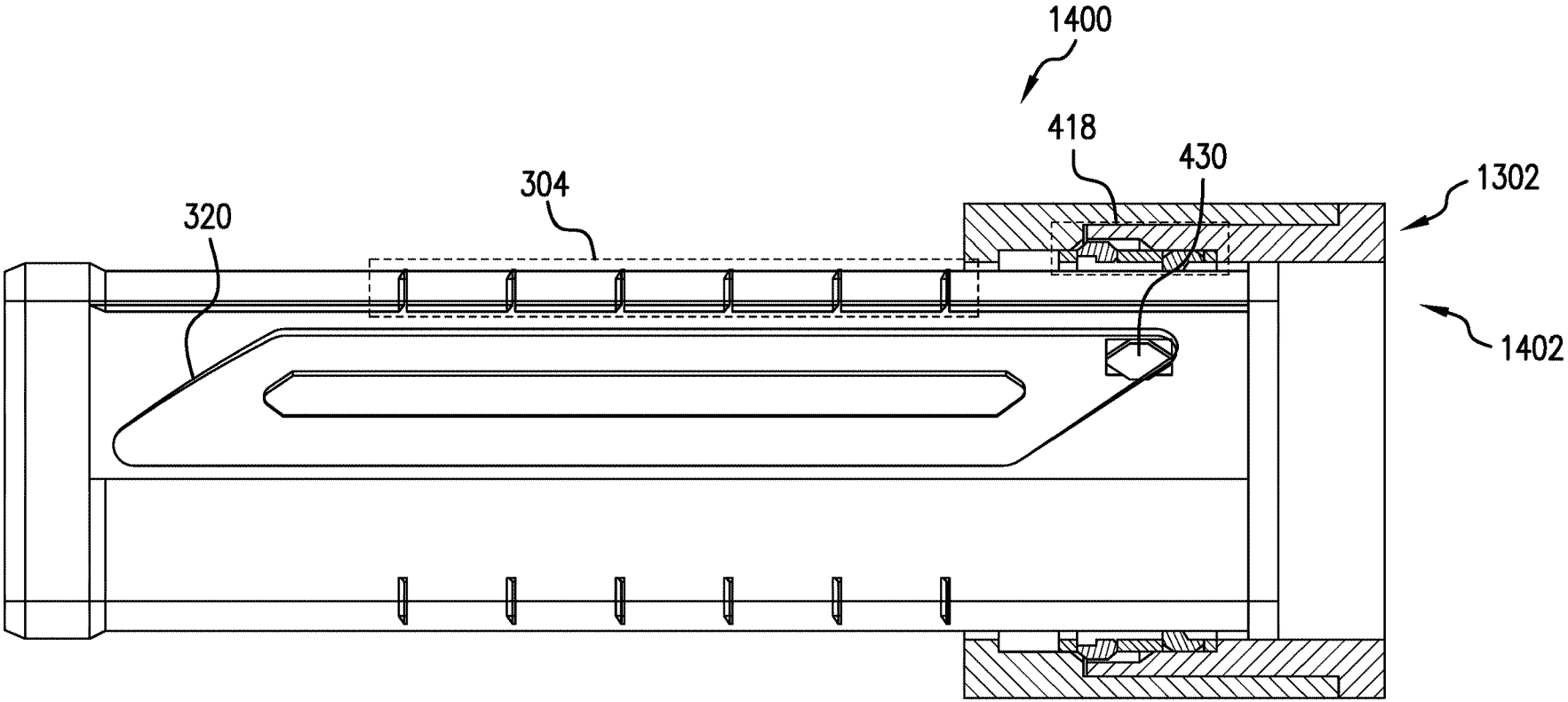
FIG. 14 illustrates a motion for rotating the carrier out of alignment with the insert.

FIG. 14 illustrates a motion for rotating the insert 104 out of alignment with the carrier 402. Due to the diagonal trajectory of the second angled cross-slot 328, moving the insert 104 further to the left (in the first direction) causes the carrier 402 to rotate with respect to the insert 104, thereby aligning the lug 430 with the second axial slot 324. As a result, the first protrusion group 304 is no longer at the same circumferential location 1302 as a first aperture group 418, but is instead at the circumferential location 1402. Similarly, the second protrusion group 310 is out of alignment with the second aperture group 420 and the third protrusion group 312 is out of alignment with third aperture group 422.

Figure 15:
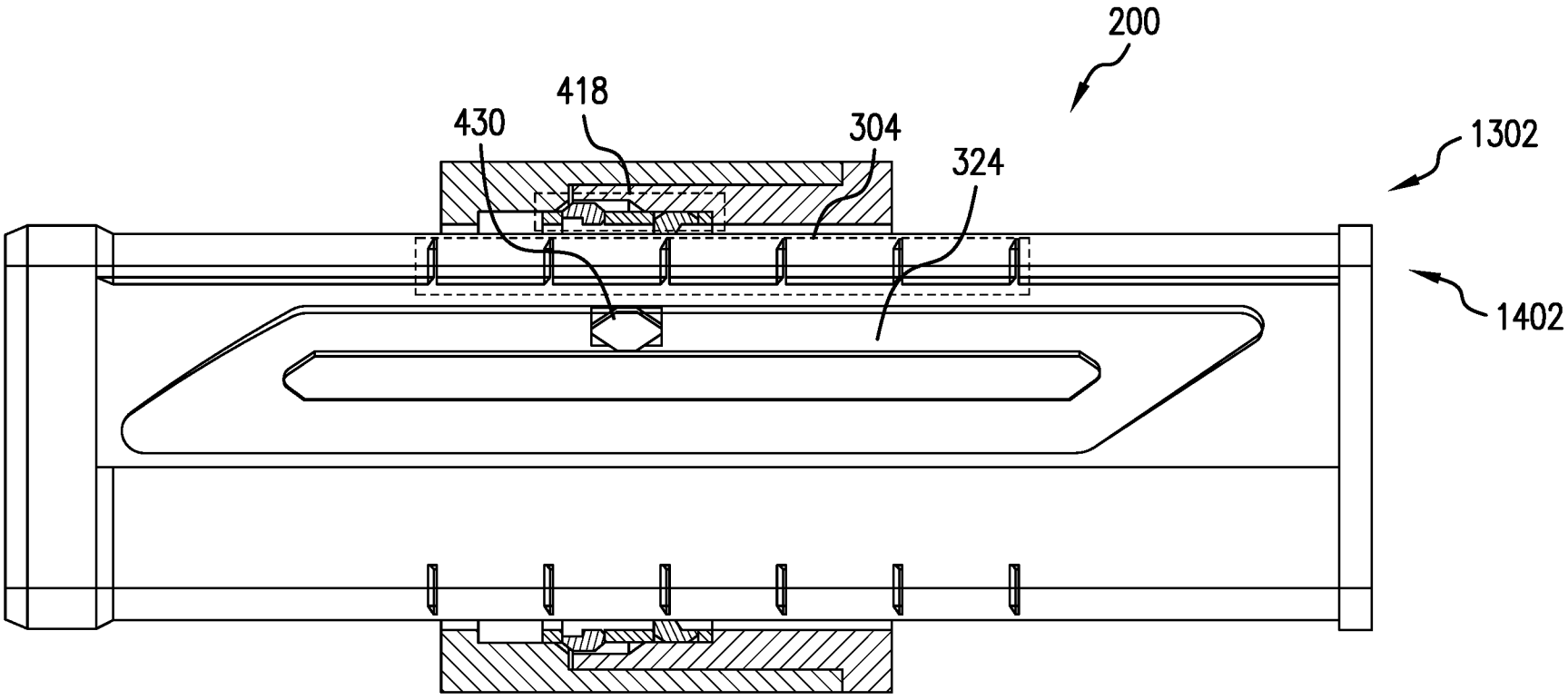
FIG. 15 illustrates the insert in free axial motion with respect to the stepper sleeve.

FIG. 15 illustrates the insert 104 in free axial motion in the second direction with respect to the stepper sleeve 106 with the protrusion groups circumferentially displaced from their respective aperture groups. The lug 430 now moves along the second axial slot 324.

Figure 16:
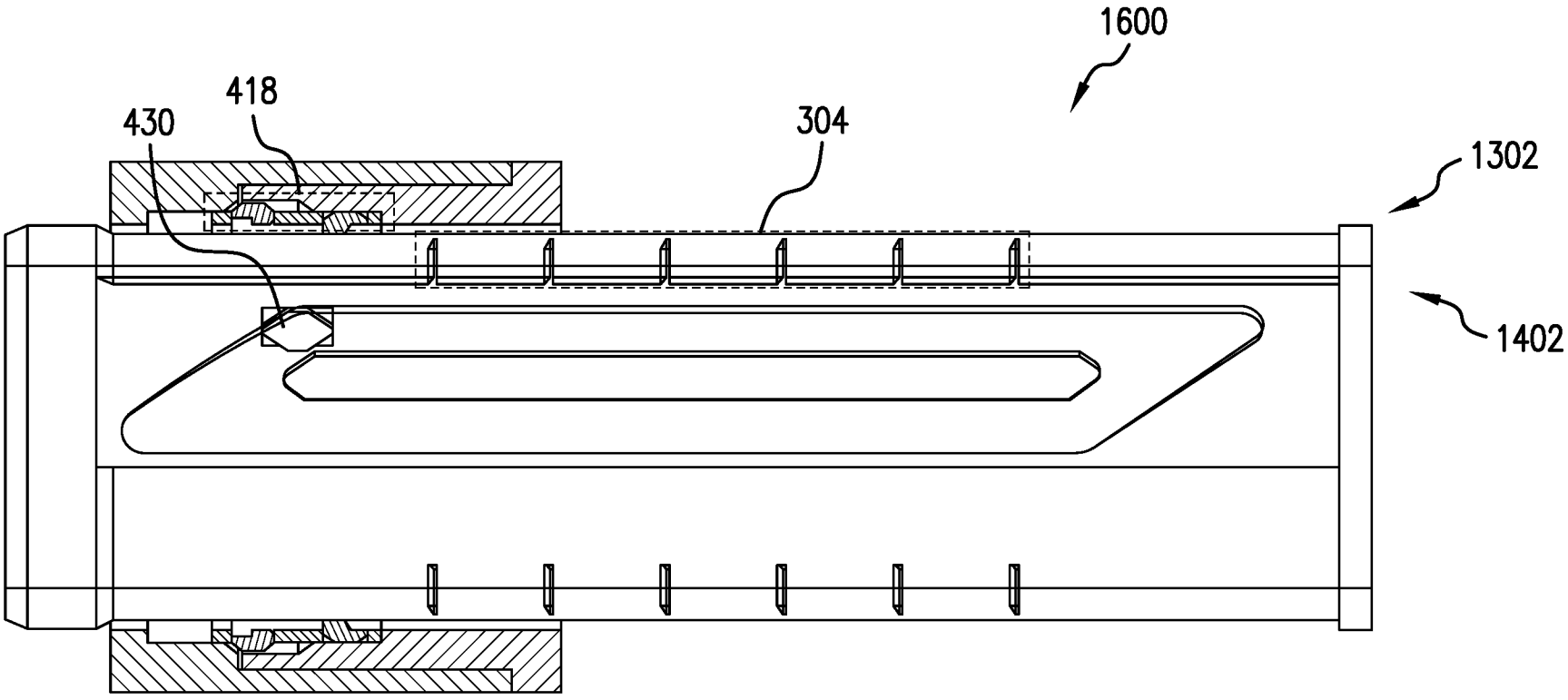
FIG. 16 illustrates the insert have been moved to the right of the stepper sleeve after the motion of FIG. 15.

FIG. 16 illustrates the insert have been moved to the right of the stepper sleeve 106 after the motion of FIG. 15. The lug 430 is now at the left-most position within the second axial slot 324.

Figure 17:
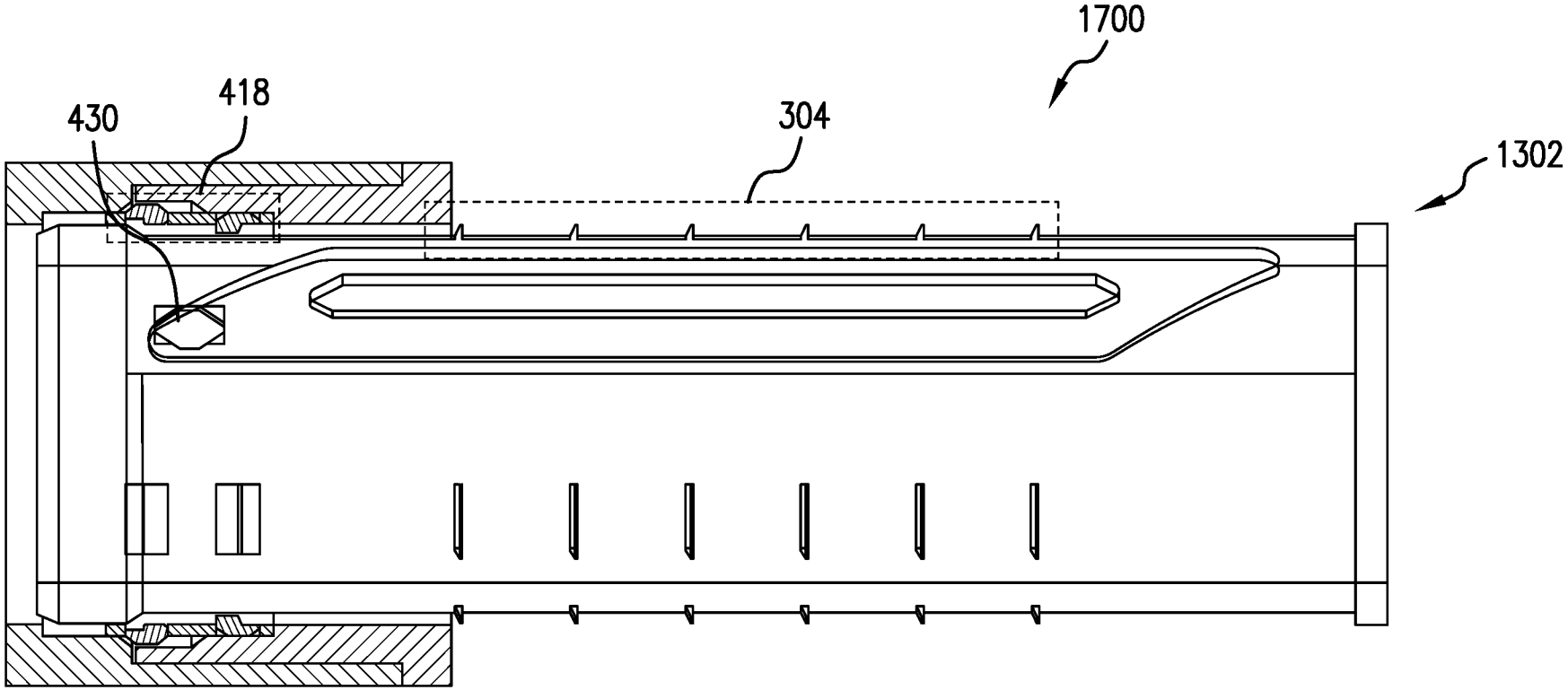
FIG. 17 illustrates a motion for rotating the insert into alignment with the carrier for producing stepped motion.

FIG. 17 illustrates a motion for rotating the insert 104 into alignment with the carrier 402 for producing stepped motion. Due to the diagonal trajectory of the first angled cross-slot 326, moving the insert 104 further to the right (in the second direction) causes the carrier 402 to rotate with respect to the insert 104, thereby aligning the lug 430 with the first axial slot 322. As a result, the first protrusion group 304 is placed at the same circumferential location 1302 as a first aperture group 418. In this alignment, the protrusions 306*a*, 3062*b*, . . . , 306*n* can interact with the first and second stop members when the insert is once again moved in the first direction, thereby producing the stepping motion described in FIGS. 6-12.

Figure 18:
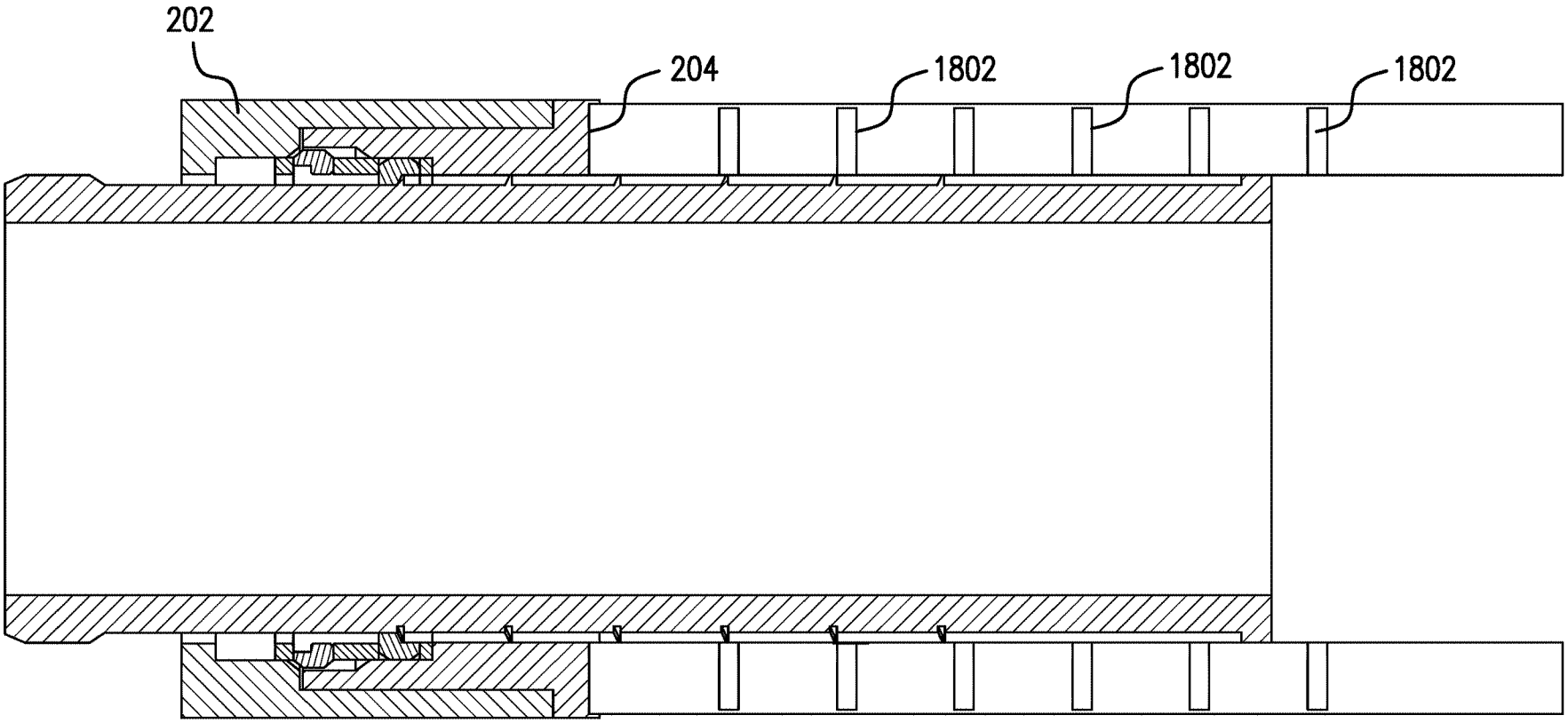
FIG. 18 illustrates an operation of the mechanical stepper in order to control a flow of fluid through the housing.

FIG. 18 illustrates an operation of the mechanical stepper 100 in order to control a flow of fluid through the housing 102. The insert 104 includes a flow passage for a flow of fluid therethrough. The second housing section 204 extends axially and includes a plurality of ports 1802. The relative position of the insert 104 within the second housing section 204 determines how many ports 1802 are covered by the insert and consequently determines an amount of fluid that enters the second housing section 204 via the ports 1802. When the insert 104 is farthest to the right, the insert can cover all of the ports 1802. As the insert 104 moves to the left another port 1802 is uncovered by the insert 104. The spacing between the ports 1802 can be the same as the spacing between protrusions 306*a*, 3062*b*, . . . , 306*n*. The insert 104 can be moved through the housing 102 due to an applied force. In various embodiments, the applied force can be a hydraulic force, a mechanical force, an electrical force, a magnetic force, an electromagnetic force, etc. The force can be applied by a mechanically operated actuator, an electrically operated actuator, etc. The mechanical stepper 100 can regulate a flow of fluid through the insert 104 and through the housing 102.

Figure 19:
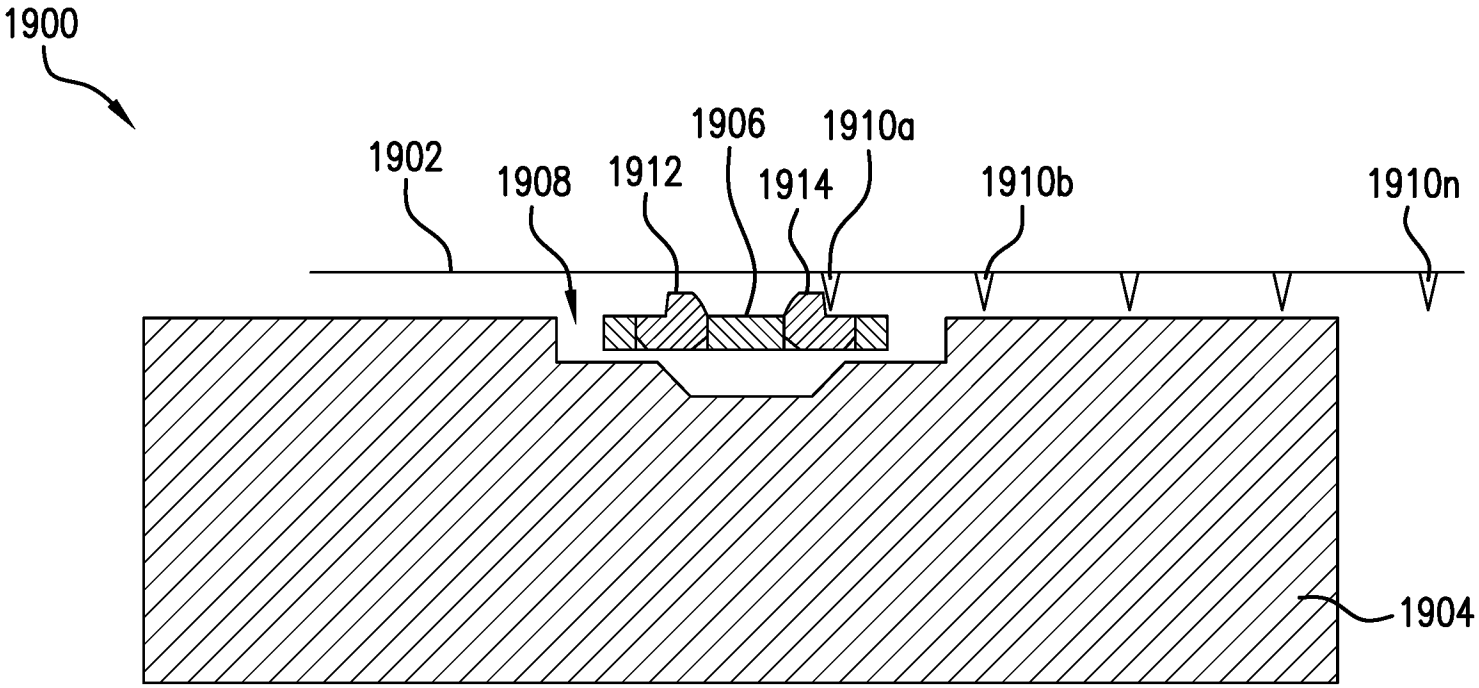
FIG. 19 shows a mechanical stepper in another embodiment.

FIG. 19 shows a mechanical stepper 1900 in another embodiment. The mechanical stepper 1900 includes a housing 1902, insert 1904 and stepper sleeve 1906. A cavity or recess 1908 is formed the outer surface of the insert and the stepper sleeve 1906 resides within the recess 1908. The housing 1902 includes protrusions 1910*a*, . . . , 1910*n* that interact with first stop member 1912 and second stop member 1914 of the stepper sleeve in order to cause the insert to move through the housing in an incremental manner. The radial orientation of the first stop member 1912 and second stop member 1914 are reversed from that of first stop member 404 and second stop member 406, thereby allowing interact with the protrusions 1910*a*, . . . , 1910*n* to change their radial states. For the stop members 1912 and 1914, the equilibrium position of the first stop member 1912 is in a radially inward position and the equilibrium position of the second stop member 1914 is a radially outward position.

In another embodiment, the mechanical stepper can be used as a counter by, for example, tracking a number protrusions that have passed through the stepper sleeve or by tracking a number of ports uncovered by the insert.

Set forth below are some embodiments of the foregoing disclosure:

Embodiment 1: A method of incrementally actuating a device including placing an insert within a housing, the housing having a cavity and a stepper sleeve located within the cavity, the stepper sleeve including a first stop member having an equilibrium position defined by a first equilibrium diameter and a second stop member having an equilibrium position defined by a second equilibrium diameter less than the first equilibrium diameter, the insert including a first protrusion, moving the insert through the housing, and incrementally restricting a motion of the insert through the housing by changing a diameter of the first stop member and a diameter of the second stop member via the first protrusion.

Embodiment 2: The method of any prior embodiment, wherein incrementally moving the insert through the housing further forming a first contact between the first protrusion and the second stop member with the stepper sleeve in a first position within the cavity, moving the insert in a first direction to move the stepper sleeve from a first position to a second position within the cavity via the first contact, moving the insert in the first direction to move the first protrusion past the second stop member, moving the insert in the first direction to move the first protrusion to contact the first stop member, moving the insert in a second direction to move the stepper sleeve back to the first position via a second contact between the first protrusion and the second stop member, and moving the insert in the first direction to move the first protrusion past the first stop member.

Embodiment 3: The method of any prior embodiment, wherein moving the stepper sleeve to the second position collapses the first stop member from its equilibrium position and moving the stepper sleeve to the first position allows the first stop member to expand back to its equilibrium position.

Embodiment 4: The method of any prior embodiment, wherein the cavity further comprises an expanded region and a restricted region, wherein the first stop member is in the expanded region when the stepper sleeve is in the first position and is in the restricted region when the stepper sleeve is in the second position.

Embodiment 5: The method of any prior embodiment, wherein moving the first protrusion past the first stop member places a second protrusion into contact with the second stop member.

Embodiment 6: The method of any prior embodiment further comprising rotating the first stop member and the second stop member out of alignment with the first protrusion to move the insert without moving the stepper sleeve.

Embodiment 7: The method of claim 1, further comprising moving the insert due to a force applied to the insert.

Embodiment 8: The method of any prior embodiment, wherein moving the insert with respect to the housing opens a port to a flow passage.

Embodiment 9: The method of any prior embodiment, wherein movement of the stepper sleeve and of the first stop member and the second stop member causes a motion of the insert.

Embodiment 10: A mechanical stepper, including a housing having a cavity on an inner diameter surface, a stepper sleeve within the cavity, the stepper sleeve including a first stop member having an equilibrium position defined by a first equilibrium diameter and a second stop member having an equilibrium position defined by a second equilibrium diameter less than the first equilibrium diameter, and an insert within the housing and movable with respect to the housing, the insert including a protrusion, wherein the insert moves incrementally through the housing via interaction between the protrusion on the insert and the first stop member and the second stop member.

Embodiment 11: The mechanical stepper of any prior embodiment, wherein at least one of the first stop member and the second stop member is a C-ring.

Embodiment 12: The mechanical stepper of any prior embodiment, wherein the first stop member is in its equilibrium position when the stepper sleeve is in a first position within the cavity and is in a collapsed position when the stepper sleeve is in a second position within the cavity.

Embodiment 13: The mechanical stepper of any prior embodiment, wherein the cavity further comprises a expanded region and a first restricted region, wherein the first stop member is in the expanded region when the stepper sleeve is in the first position and is in the first restricted region when the stepper sleeve is in the second position.

Embodiment 14: The mechanical stepper of any prior embodiment, wherein the cavity further comprises a second restricted region, wherein the second stop member is in the second restricted region when the stepper sleeve is in the first position and is in the expanded region when the stepper sleeve is in the second position.

Embodiment 15: The mechanical stepper of any prior embodiment, wherein the insert further comprises a grooved track for rotating the first stop member and the second stop member out of alignment with the protrusion.

Embodiment 16: The mechanical stepper of any prior embodiment, wherein the housing includes a port, wherein a force applied to the insert moves the insert with respect to the housing to uncover the port.

Embodiment 17: A mechanical stepper, including a housing having a protrusion on an inner diameter surface, an insert within the housing and movable with respect to the housing, the insert including a cavity on its outer surface, and a stepper sleeve within the cavity, the stepper sleeve including a first stop member having an equilibrium position defined by a first equilibrium diameter and a second stop member having an equilibrium position defined by a second equilibrium diameter greater than the first equilibrium diameter, wherein the insert moves incrementally through the housing via interaction between the protrusion on the housing and the first stop member and the second stop member.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A mechanical stepper, comprising:

a housing having a protrusion on an inner diameter surface;

an insert within the housing and movable with respect to the housing, the insert including a cavity on an outer surface of the insert; and a stepper sleeve within the cavity, the stepper sleeve including a first stop member having an equilibrium position defined by a first diameter and a second stop member having an equilibrium position defined by a second diameter greater than the first diameter;

wherein the stepper sleeve is configured to move from a first position to a second position within the cavity via a motion of the insert within the housing through a contact between the protrusion and second stop member, thereby expanding the first stop member from the first diameter to the second diameter; and wherein movement of the insert through the housing with the stepper sleeve in the second position moves the first protrusion to collapse the second stop member from the second diameter to the first diameter.

* * * * *